US007151901B2

(12) United States Patent
Hirai

(10) Patent No.: US 7,151,901 B2
(45) Date of Patent: Dec. 19, 2006

(54) IMAGE FORMING APPARATUS AND ASSOCIATED METHOD OF DETECTING DEVELOPER DETERIORATION

(75) Inventor: Shuji Hirai, Ota-ku (JP)

(73) Assignee: Ricoh Company, Ltd., Tokyo (JP)

( * ) Notice: Subject to any disclaimer, the term of this patent is extended or adjusted under 35 U.S.C. 154(b) by 96 days.

(21) Appl. No.: 10/716,536

(22) Filed: Nov. 20, 2003

(65) Prior Publication Data

US 2004/0151514 A1 Aug. 5, 2004

(30) Foreign Application Priority Data

Nov. 20, 2002 (JP) ..... 2002-336065

(51) Int. Cl.
*G03G 15/00* (2006.01)
*G03G 15/08* (2006.01)

(52) U.S. Cl. ..... 399/29; 399/46; 399/61; 399/257

(58) Field of Classification Search ..... 399/27, 399/29, 30, 58, 61, 62, 63, 64, 38, 46, 50, 399/51, 53, 55, 258, 257
See application file for complete search history.

(56) References Cited

U.S. PATENT DOCUMENTS 4,538,897 A * 9/1985 Osaka et al. ..... 399/29
4,896,184 A * 1/1990 Kamitamari et al. ..... 399/29
5,235,391 A * 8/1993 Aimoto ..... 399/29
5,310,423 A * 5/1994 Aimoto et al. ..... 399/62 X
5,619,312 A * 4/1997 Hatano et al. ..... 399/61
5,797,062 A * 8/1998 Wada et al. ..... 399/29
6,125,243 A * 9/2000 Shoji et al. ..... 399/29
6,892,036 B1 * 5/2005 Ito ..... 399/27
2003/0123889 A1 * 7/2003 Isobe et al. ..... 399/27
2004/0151514 A1 8/2004 Shuji

FOREIGN PATENT DOCUMENTS

JP 05-035162 A * 2/1993
JP 06-083179 A * 3/1994
JP 6-130818 5/1994
JP 8-106211 4/1996
JP 10-026880 A * 1/1998

OTHER PUBLICATIONS

Webster's II New Riverside University Dictionary, The Riverside Publishing Company published in 1994, p. 736.*
U.S. Appl. No. 10/986,781, filed Nov. 15, 2004, Matsuura et al.

* cited by examiner

*Primary Examiner*—Sophia S. Chen
(74) *Attorney, Agent, or Firm*—Oblon, Spivak, McClelland, Maier & Neustadt, P.C.

(57) ABSTRACT

An image forming apparatus including a latent carrier and a charging device. The charging device is configured to charge a surface of the latent carrier. An exposure device is configured to expose a surface of the latent carrier for forming a latent image thereon. A transfer device is provided to transfer a developed toner image on the latent carrier to a recording medium. The image forming apparatus includes a developing device having a pooling portion configured to pool a two-component developer and an agitating device configured to agitate developer in the pool portion. A developer carrier replenishes developer to the latent carrier. A first measurement device and a second measurement device are configured to measure developer characteristics wherein the first and second measurement devices compare their respective outputs to measure a deterioration rate of the developer.

17 Claims, 7 Drawing Sheets

IMAGE FORMING APPARATUS AND ASSOCIATED METHOD OF DETECTING DEVELOPER DETERIORATION

BACKGROUND OF THE INVENTION

The present invention relates to an electro-photographic image forming apparatus, and, more particularly, to a device, such as a printer and/or facsimile device, and associated method of detecting and compensating for developer deterioration therein.

Developer deterioration is defined as an improper balance of toner particles and/or carrier particles in the two-component developer necessary for creating a desired image reproduction quality in an image forming apparatus.

In the conventional image forming apparatus, a two-component developer is commonly utilized; the two-component developer includes a toner and a carrier. In this two-component developer, the non-magnetic toner particle is charged by agitating the magnetic carrier. The agitation of the two-component developer is typically performed by a developing means of the image forming apparatus. Yet, such agitation deteriorates the two-component developer over time. This deterioration in the developer degrades image quality.

Such developer deterioration may be expressed as a change in overall developer density, electrical resistance of the developer, fluidity and charge per unit of mass (Q/M). For example, it is disclosed to detect a deterioration degree of the developer by using a sensor that is detecting a quantity of the carrier component in the two-component developer (Japan Laid Open Patent No. HEI6-130818). The sensor in this arrangement measures the magnetic permeability of the two-component developer. In other words, the magnetic permeability of the two-component developer is determined by the amount of carrier occupying a predetermined volume; likewise, the sensor may also detect toner density indirectly. Yet, using a two-component developer, in an advanced deterioration state will lead to an overall density variation, such a developer density variation is independent of toner density. In other words, a magnetic permeability sensor alone cannot accurately measure the toner density when the developer has deteriorated.

In the method described above, two magnetic permeability sensors are used, one sensor is used as a toner density sensor, the other sensor is used a as a developer deterioration sensor, and both sensors are installed in different locations in the developing device. One sensor is installed in an area of low variation in overall density, used as a toner density detection sensor, while the other sensor is installed in an area of relatively higher overall density variation for use as a developer deterioration sensor. Thus, developer deterioration is determined based upon the difference of data provided by both sensors.

The limitation of the above approach is that the magnetic permeability sensor detects the developer layer on a developing sleeve as an area that the variation of density changes little overall. However, a magnetic permeability sensor can detect a wide area, thus the sensor detects an area that includes a developing sleeve and a developing roller. As the developing layer is relatively thin, the ability of the magnetic permeability sensor to accurately measure the toner density is substantially limited. It is preferred that the permeability sensor measure areas having ample developer, however, in such areas, bulk density greatly fluctuates as noted above. Thus, using sensors which measure magnetic permeability alone is inadequate.

Further, a second method is known in which the output of a toner quantity sensor and a toner density measurement are provided to detect the deterioration of a two-component developer (Japan Laid Open Patent No. HEI8-106211). This reference shows the use of an optical reflection density sensor together with a toner quality sensor or a toner quantity sensor used together with a magnetic permeability sensor. This method describes measuring the resistance value of a developer in order to determine the degree of developer deterioration. In this method, the toner density is determined by the toner density measurement sensor. Upon measuring the toner density, the degree of developer is determined by comparing the difference between a toner quantity adhered on the image carrier and an actual toner quality measured by the toner quantity sensor. Thus, the developer deterioration value depends upon the toner quantity sensor output. This method is limited in that the toner adhesion quantity, as indicated by the sensor output, is not only related to developer deterioration.

For example, the deterioration of the photo conductor is also a parameter which can impact toner adhesion quantity. When a photoconductor has deteriorated, charging ability varies so that electrostatic and image bias differ from that of an initial state. As a result, even if a developer characteristic does not vary, a toner adhesion quantity varies.

Presently, a method of detecting developer deterioration is desired in which the above-mentioned short comings are avoided.

SUMMARY OF THE INVENTION

An image forming apparatus is provided for providing a precise measurement of developer deterioration for maintaining image quality. In an exemplary embodiment of the invention, an image forming apparatus includes a latent carrier, a charging device, an exposure device, a transfer device, and a developing device. The developing device includes a pooling portion for pooling two-component developer and an agitating portion to agitate the two-component developer. A developer carrier is provided for replenishing carrier to the latent carrier, and a first and second measurement device are also provided. The first measurement device and second measurement device are configured to compare their associated outputs to measure a deterioration rate of the two-component developer.

It is to be understood that both the foregoing general description of the invention and the following detailed description are exemplary, but are not restrictive of the invention.

BRIEF DESCRIPTION OF THE SEVERAL VIEWS OF THE DRAWINGS

The invention is best understood from the following detailed description when read in conjunction with the accompanying drawings.

DETAILED DESCRIPTION OF THE INVENTION

An image forming apparatus of an exemplary embodiment of the present invention will be explained below with reference to the accompanying drawings.

Figure 1:
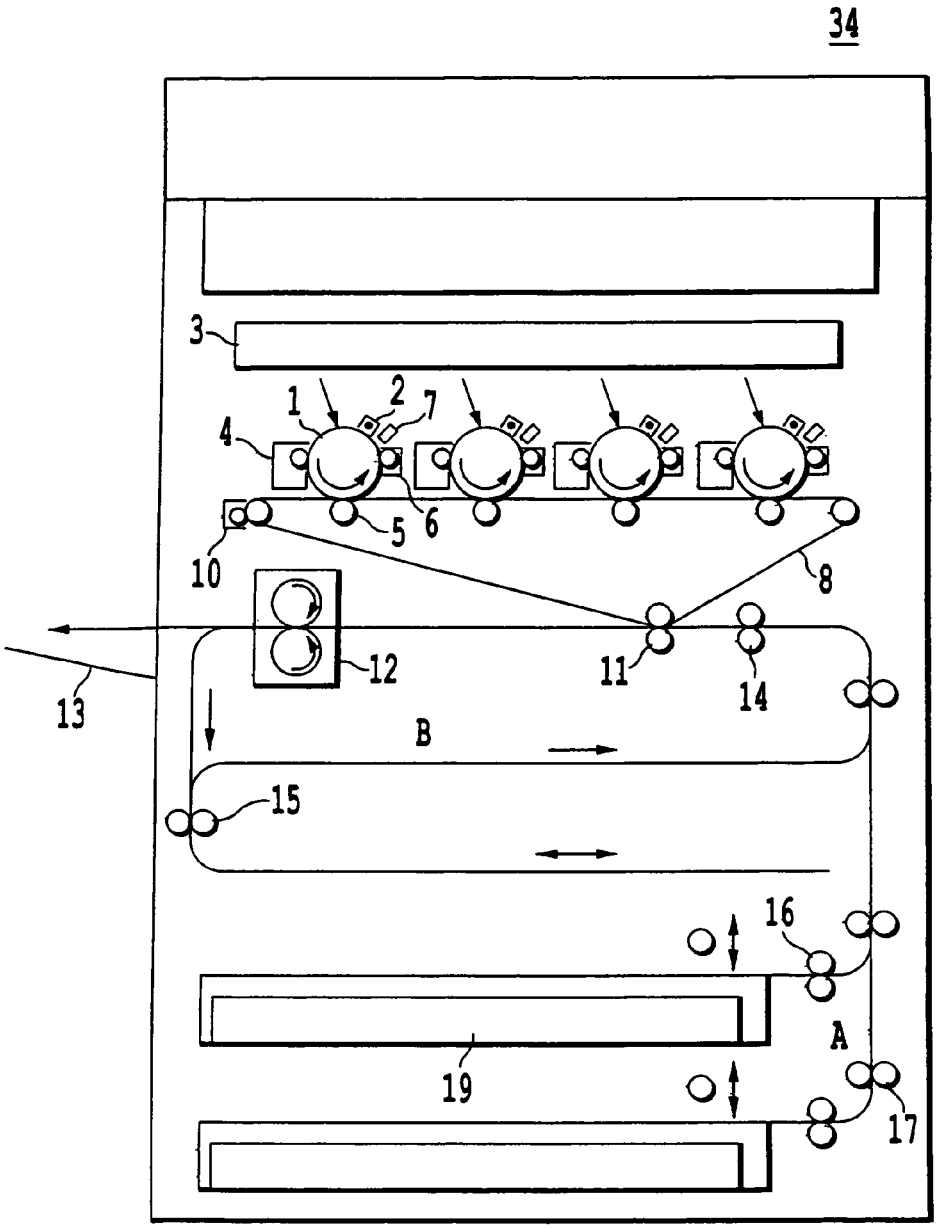
FIG. 1 shows a schematic diagram of an image forming apparatus in accordance with an exemplary embodiment of the invention.

As shown more specifically in FIG. 1, a schematic diagram of an image forming apparatus of the exemplary embodiment of the invention is shown. A developing system of the exemplary embodiment utilizes dry, two-component developer. The developer includes a non-magnetic toner and a magnetic carrier. An image apparatus 34 provides four color images in an overlapping manner to provide a composite color image to a transfer belt. To this end, a transfer belt carries an image corresponding to each one of the color image drums for creating the composite image on a recording medium as explained below.

Upon actuation of the device by the initiation of a "print" command or the like, a recording medium is provided from feed tray 19 in the lower part of the apparatus 34 to a conveying path A with the help of rollers 16 and 17. Each photoconductor 1 is charged uniformly about its surface by a charging device 2 and the surface of the photoconductor is exposed to receive image data by a writing unit 3. The exposure pattern formed on the photoconductor 1 is referred to herein as a latent image. A latent image is formed on a corresponding one of the photoconductors such that a specified color image may be formed respectively therein. For example, in the exemplary embodiment, each of the four photoconductors 1 corresponds to the colors black, yellow, magenta and cyan. In this way, the toner image developed on the photoconductor is transferred to the transfer belt 8 at a contact point between transfer roller 5 and the photoconductor 1. Thus, a full-color toner image is formed on the transfer belt 8 by repeating this process with respect to each photoconductor 1. The full-color toner image formed on the intermediate transfer belt 8 is transferred to the paper conveyed by roller 14 along conveying path A. Those skilled in the art will recognize that the specific colors number of colors and number of photoconductors 1 described herein may be varied based on a desired application.

A transcription process is performed by a first transcription bias at roller 14 and second transcription bias applied to the paper by second transfer roller 11, which also applies a pressing force. The full-color toner image transcribed to the recording medium is fixed by passing the recording medium through a fixing unit 12.

If the recording medium is to carry a one-sided printing, the recording medium is conveyed to an eject tray 13 along conveying path A. In the case of a double-sided print, the recording medium is conveyed to a recording medium orientation section of FIG. 1. The recording medium is reversed in a conveyance direction by the paper orientation part via a switch-back roller 15. In this way, the front and back of a recording medium can be reversed for facilitating double-sided printing as the reversed recording medium does not return to the fixing unit 12, but instead is conveyed along a second path B such that a toner image may be transferred to the opposing side of the recording medium as outlined above.

After transferring an image to transfer belt 8, photoconductor 1 has a first residual toner on a surface thereof. The residual toner is removed from the photoconductor 1 by cleaning unit 6. Likewise, the surface of the photoconductor is uniformly discharged by quenching lamp 7 so that a subsequent charging process can be performed for forming a next image to the transfer belt 8. Likewise, residual toner is adhered on the surface of the intermediate transfer belt 8 after transcription via transcription part 11. This residual toner is removed by the transfer belt 8 via cleaning unit 10 to prepare for the next toner image transfer process.

Figure 2:
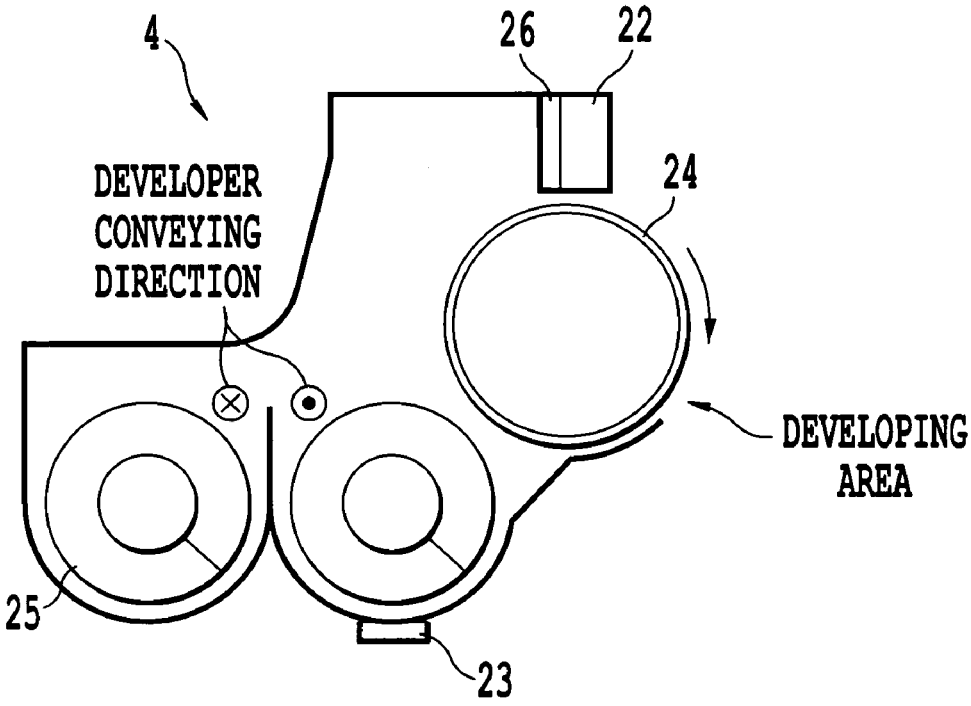
FIG. 2 shows a schematic diagram of a developing device of the image forming device of FIG. 1.

A developing device of the image forming apparatus of FIG. 1 is shown in greater detail in FIG. 2. In the exemplary embodiment, a sensor of a first type, an optical toner concentration sensor 22, is provided to measure reflection light strength of the developer. A sensor of a second type, magnetic permeability sensor 23, is provided to measure magnetic permeability of the developer. The optical toner concentration sensor 22 is substantially disposed on the developing sleeve 24 in close relation to a doctor blade 26. In this way, an optical reflection characteristic, which is not affected by overall developer density, fluidity, resistance and charge per unit of mass (Q/M), is utilized. The magnetic permeability sensor 23 is disposed substantially at a lower portion of the developing device 4, and forward of an agitating portion 25. Those skilled in the art will recognize that the position of the toner density sensor may be altered to a location anywhere within the developing device in which the toner is sufficiently agitated and developer properties can be ascertained prior to delivery of the toner to the developer area of FIG. 2.

Figure 3:
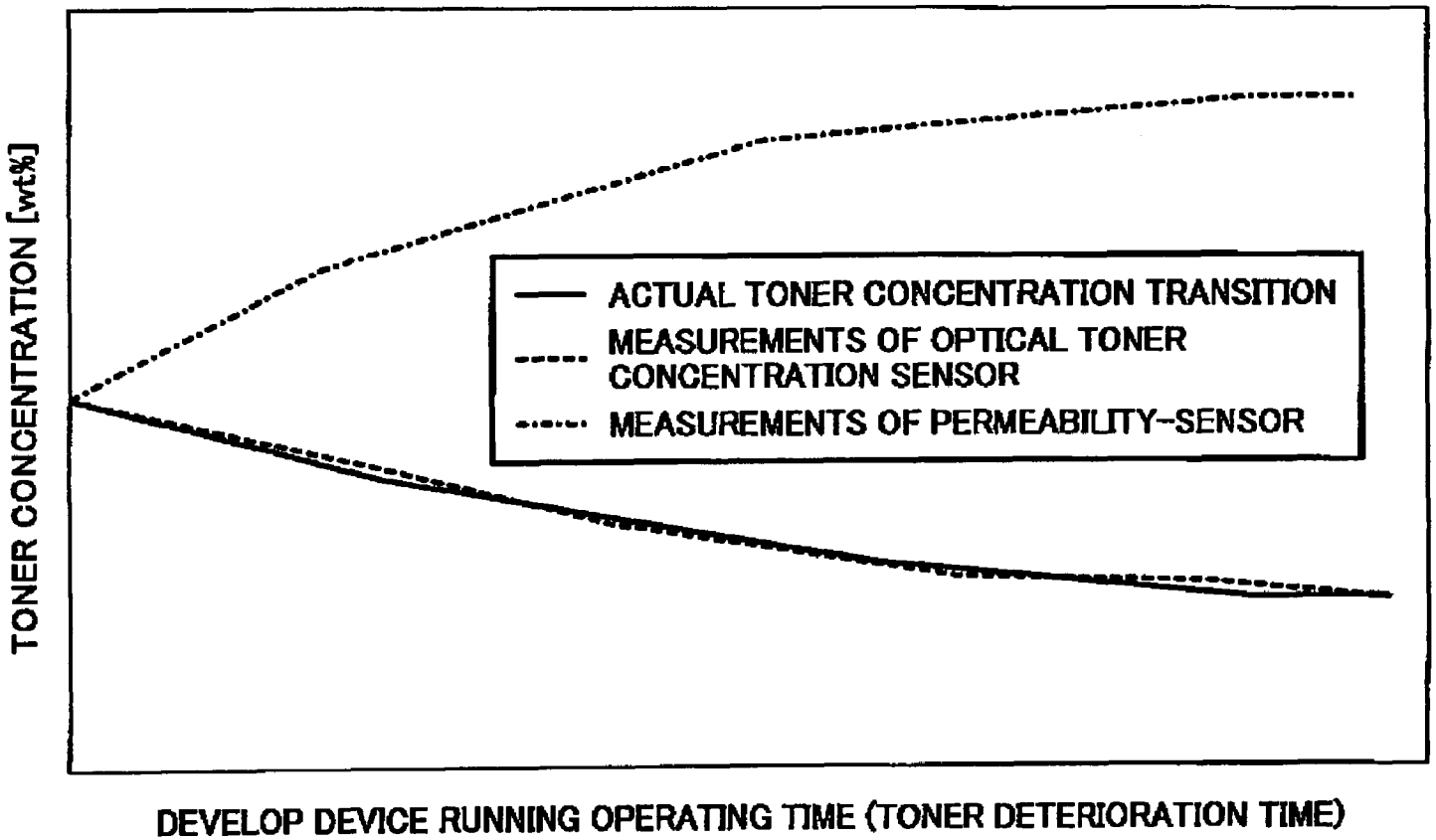
FIG. 3 shows a graph exhibiting toner concentration as it relates to toner deterioration.

Referring now more specifically to FIG. 3, an outline of the output of both sensor types as the developer deteriorates is shown. The graph shows a condition in which the toner is not replenished in order to better illustrate the operation of the sensor arrangement. The solid line corresponds to an actual toner concentration transition. The break-down line corresponds to measurements of the optical toner concentration sensor 22 and the chain-line corresponds to the measurements of the permeability sensor 23. In use, the toner density value decreases due to the toner used in the developer device 4. In addition, the developer in the developing device 4 begins to deteriorate via the agitation process.

In the exemplary embodiment, the optical toner concentration sensor 22 measures the toner density correctly regardless of the degree of developer deterioration. This is due to the fact that the optical characteristic measured by sensor 22 is not affected by developer deterioration. Conversely, the outline value of the magnetic permeability sensor 23 is shifted from the solid line as shown in FIG. 3. This relation is due to the inability to the magnetic permeability sensor 23 to accurately measure the toner density as overall density of the developer is varied in proportion to the deterioration of the developer. Furthermore, the carrier density that is measured by a magnetic permeability sensor is also varied. Together, these changes vary the output of the magnetic permeability sensor 23 independent of toner density. Thus, the difference between the output measured by the magnetic permeability sensor 23 and the actual toner density corresponds to the degree of developer deterioration (overall density change). In this way, the degree of developer deterioration is detected by judging a difference between the toner density (chain line in FIG. 3) measured by the magnetic permeability sensor 23 and the actual toner density (solid line in FIG. 3).

In an alternative embodiment, a second type of measuring device is a load measuring device. The load measuring device is used to measure a load driven by the agitating drive of the developing device 4 for agitating the two-component developer therein. In this case, the load measuring device is a torque measuring device (not shown), which is installed along an axis of an agitating screw 25 shown in FIG. 2. This measuring device is useful for detecting fluidity of the two-component developer which varies in correspondence to the deterioration of the developer. Thus, if an agitating screw 25 rotates in a steady state velocity, a necessary torque will vary according to the change in fluidity of the two-component developer. In this way, such a measuring device can judge the degree of developer deterioration in correspondence to the detected change in fluidity which affects the required torque. However, fluidity may vary in accordance with the ingredients of the two-component developer, for example toner density. Due to this fact, such a measurement device determines the rotation torque required to agitate a developer which is new. In other words, the rotation torque of a developer which is first introduced to the developer device and has not deteriorated due to agitation is considered "new." Thus, here again, the optical toner density sensor 22 is used to evaluate a difference of rotation torque as it relates to new toner and toner which has deteriorated by agitation.

Figure 4:
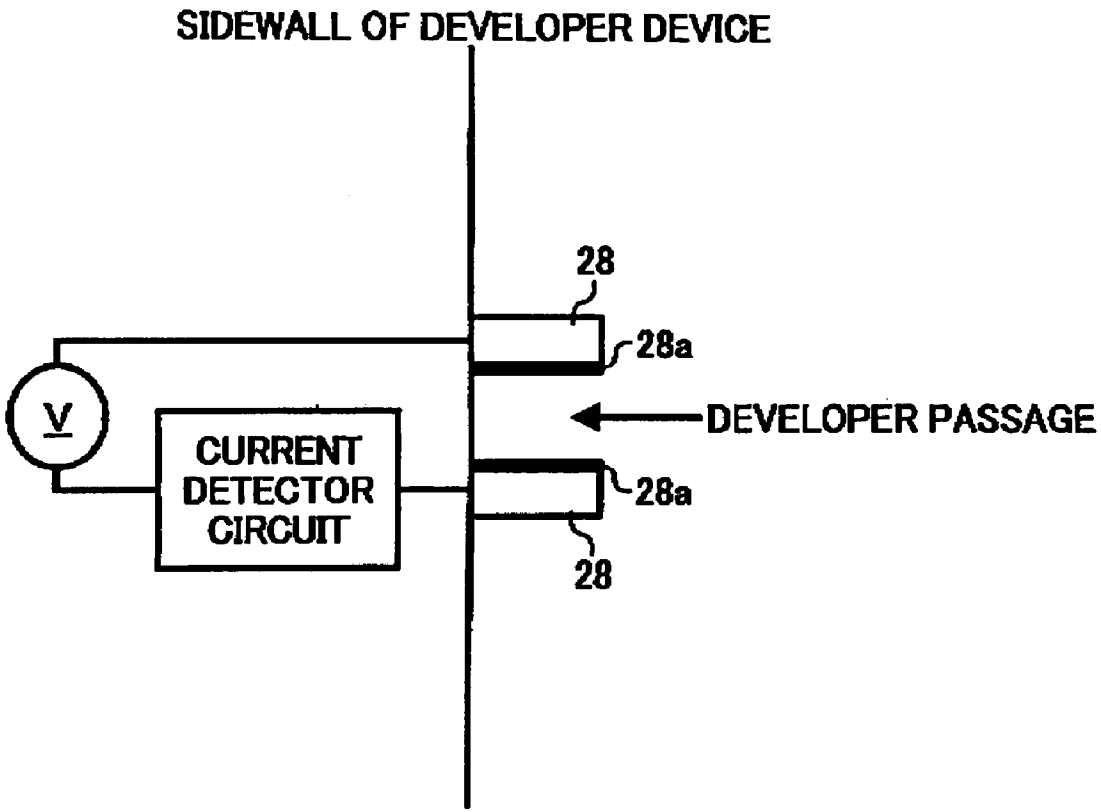
FIG. 4 shows a high-level block diagram of a resistance measurement device.

In another exemplary embodiment, the second type of measuring device may be a resistance measurement device. An exemplary resistance measure device is shown in FIG. 4. In the exemplary resistance measurement device, a facing electrode 28 is disposed on a side wall of the developer device 4 to provide a developer flow between the side walls. The measuring device measures resistance by providing an electric current through the two-component developer by adding a bias voltage to electrode faces 28*a*. The degree of developer deterioration is judged by the resistance value of the developer which changes in accordance with the distribution of carrier and toner in the two-component developer. As the resistance value of the developer will vary according to toner density, likewise, toner density is determined by sensor 23 to utilize the output of the resistance measurement sensor accurately to determine developer deterioration. Likewise, the resistance value varies according to toner density, thus new developer toner density is determined.

Figure 5:
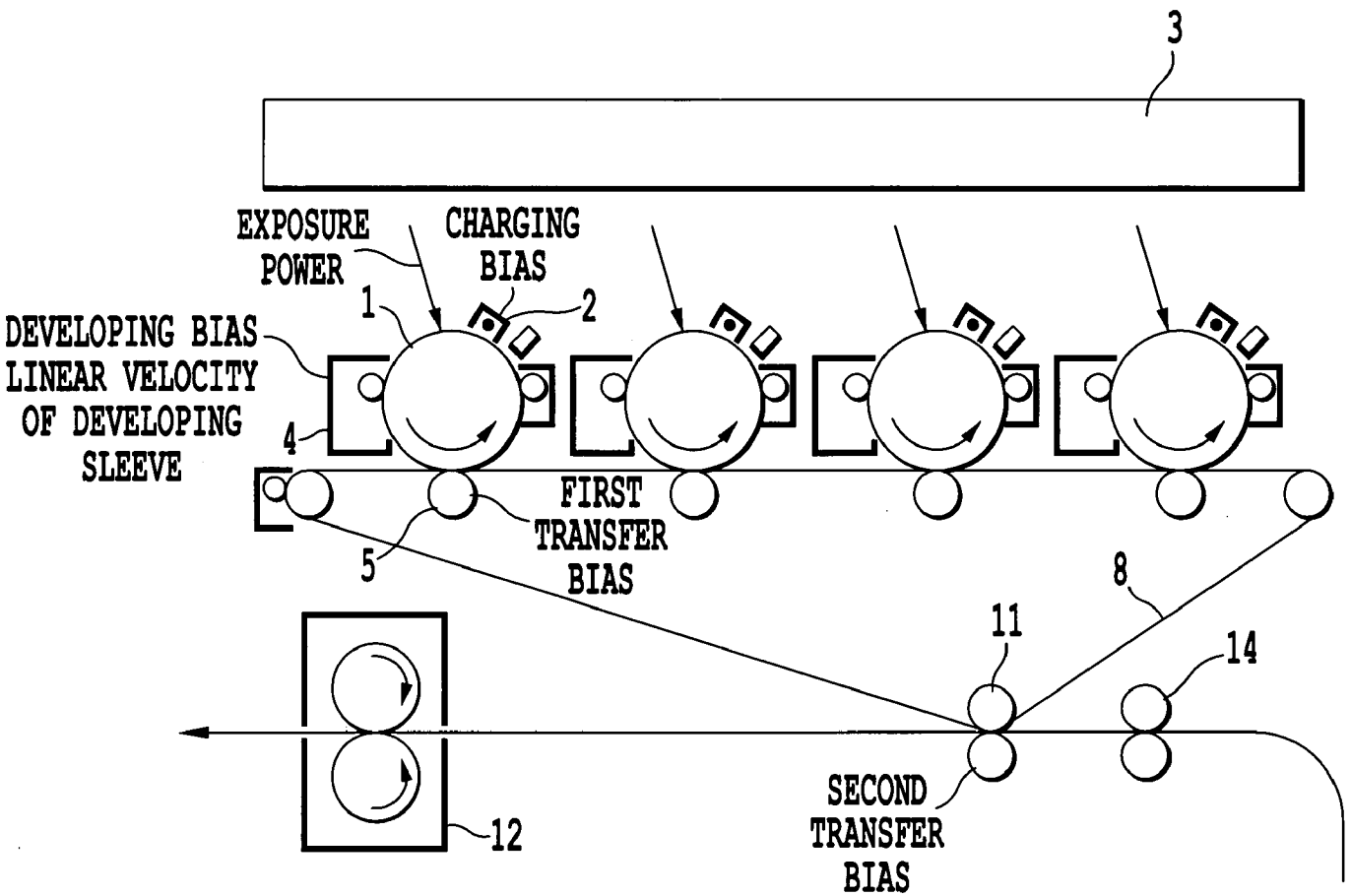
FIG. 5 shows a more detailed schematic diagram of the components of the image forming apparatus of FIG. 1.

Referring now more specifically to FIG. 5, conditions for forming an image on a recording medium are shown which may be varied to compensate for developer deterioration values detected. In FIG. 5, a developing bias, first transfer bias and second transfer bias, are shown for providing an image to a recording medium. The deterioration of developer affects the transferability of the first and second transfer bias and the developing ability as it corresponds to the developing bias. However, the transferability is affected slightly by the deterioration of developer. Conversely, developing ability is greatly affected by developer deterioration due to the change of charge quantity per toner unit mass (Q/M) which is a result of developer deterioration. Thus, if the absolute charge quantity of toner varies, the charging ability varies resulting in an image quality which degrades with respect to an identical developer bias over time as two-component developer deteriorates. Whether a change of Q/M is increasing or decreasing depends on the material of the toner and carrier, however, neither condition is desirable as it will affect image reproduction. The main reason that developer deterioration influences developing ability is a change of the Q/M value which occurs with progressing developer deterioration. Q/M defines an absolute charge quantity per toner unit mass, that is, a charging ability of toner. If the charging ability varies, absolute charge quantity of toner varies. If a latent image having a standard bias level is written on the latent carrier a different quality of toner may be provided as compared with new state (i.e., non-deteriorated toner) is adhered to the latent carrier as the charge quantity of toner is different from the new state. Thus, it is desirable to identify the degree of developer deterioration for adjusting one or more conditions of FIG. 5.

By changing one or more image forming conditions of FIG. 5, it is possible to compensate for developer deterioration, and, more specifically, changes in toner density. Of course, once the developer deterioration exceeds a certain point, it is necessary to change the supply of developer to the developing device 4. Of course, this changing of developer is preferably performed only when image quality falls below an acceptable level.

As developer deteriorates, the effect of this deterioration may be offset by a change in one or more of the conditions of FIG. 5, such as charging bias. It depends on the system whether an area maintaining electric charge on a latent image carrier is a background image or solid image. For example, a lack of density occurs in solid image area or "dirty" part may occur in a background image area. Therefore, charging bias value is adjusted so that latent image electrical current potential varies to negate these undesirable effects. In this way, the background of an image or density of a solid image can be adjusted by changing the charging bias.

Likewise, exposure power can be adjusted alone, or in combination with the adjustment of the changing bias, to vary in accordance to the degree of developer deterioration. In this case, variation in exposure power can adjust a latent potential in an area that is exposed (bright space potential) as opposed to the charging bias adjustment which adjusts a latent image potential in the area that is not exposed (dark space potential). According to a changed developing ability by a changing of Q/M caused by developer deterioration, a latent potential in the area that is exposed is adjusted to offset this change. In the case of when Q/M increases and developing ability has decreased (total quantity of a developed toner decreases because charge quantities that one toner has is relatively large), it is preferable that it makes exposure power increase in order to increase a developing potential to supplement a shortfall of developing ability. In this way, it is possible to adhere the same quantity of toner to a latent image carrier as if new developer is used.

Figure 6:
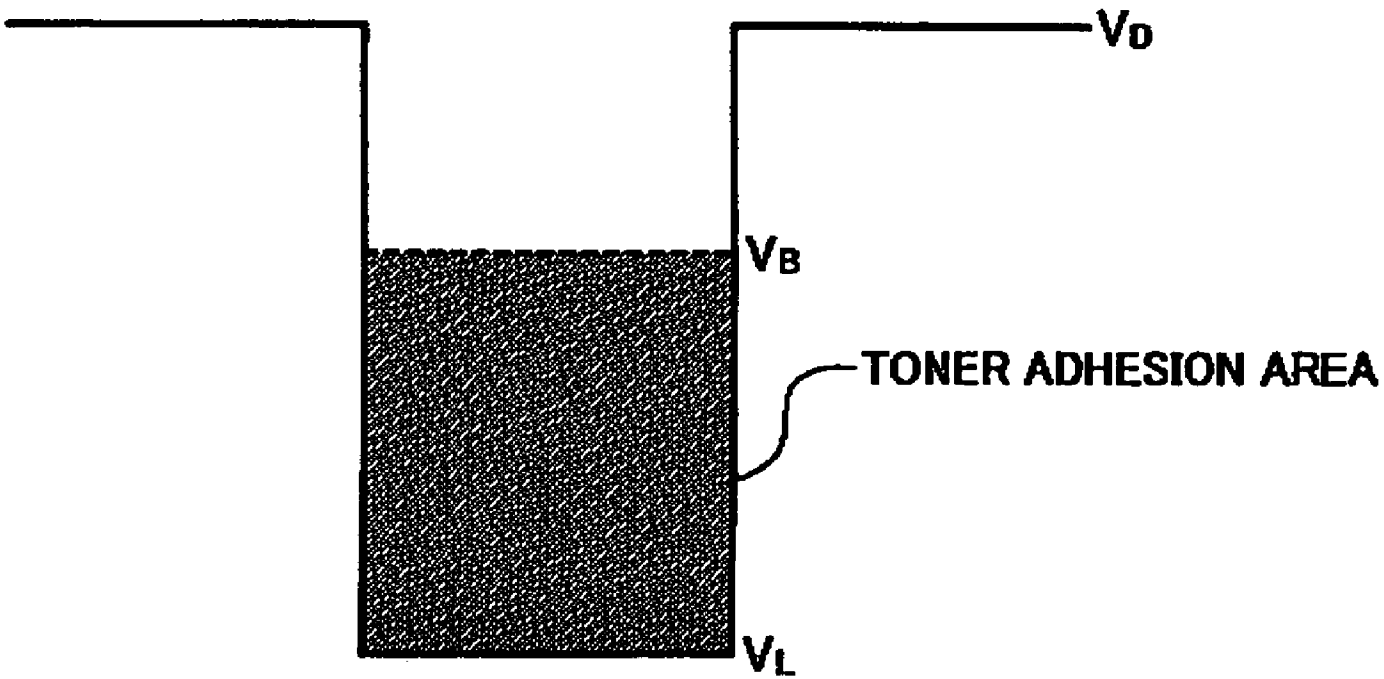
FIG. 6 shows a graph of electrical current potential.

Furthermore, the image formation condition, or combination of conditions, that is/are selected to vary can depend on the degree of developer deterioration. Moreover, an image condition which may be adjusted alone, or in combination with others, is developing bias. Referring now more specifically to FIG. 6, an electric current potential relation is shown. VD is a dark space potential determined by a charging bias, VL is a bright space potential determined by an exposure power, and VB is a developing potential determined by a developing bias. The shaded region of FIG. 6 shows a quantity of toner determined by VB. The region between VB and VD shows a toner quantity adheres to a latent carrier 1. As can be appreciated, it is possible to change a quantity of adhered toner by adjusting the developing bias VB. So, to adjust the developing bias, adjust the developing ability which negates changes in Q/M caused by developer deterioration.

A further imaging condition adjustment which may be made alone, or in combination with others, is to adjust the rotation speed of developing sleeve 24 in accordance with the degree of developer deterioration. In this way, a quantity of supplied toner can be regulated to offset the effect of developer deterioration. For example, if the developing sleeve is rotated slower with respect to a first speed to the amount of toner supplied may be regulated to adjust the actual quantity of toner for offsetting developer deterioration.

FIG. 6 shows developing ability as it relates to potential, here, another factor is a saturated developing. In other words, potential is supplied so that the developer can reproduce latent image of a desired quality. A shaded region of FIG. 6 shows the toner area. When toner is being supplied at a desired level in the developer, the toner can adhere as in FIG. 6. If a rotation of developing sleeve 24 is late, a developer is supplied less than the developing ability of the apparatus. A quantity of supplied developer to vary a rotation speed of developing sleeve 24. In a situation in which a saturated developing state is present from the beginning, it is possible to decrease a developing ability; however, by increasing rotation of developing sleeve 24, developing ability is not improved. Of course, in case that this is not a saturated developing state, both courses are possible. It can offset an affect of developer deterioration by such a principle, so the image density can be kept uniform. Further, this adjustment prevents toner scattering since the electric maintenance power of a toner particle on a developing sleeve 24 decreases when Q/M is decreased by developer deterioration. When Q/M is decreased by developer deterioration, electric maintenance power of a toner particle on developing sleeve 24 decreases. In other words, toner is easily scattered. Here, adjustment of a rotation speed of developing sleeve 24, when Q/M is decreased needs to account for toner scatter. As a quantity of a toner particle adhered to photoconductor 1 increase because of decrease of Q/M, a decrease in quantity of developer supplied in a developing area may be provided. In other words, rotation speed of developing sleeve 24 becomes late. So, a centrifugal force and impact strength of physical contact likewise decrease compared with the time that t rotation speed of developing sleeve 24 is not adjusted. This also enables environmental pollution caused by developer deterioration to be reduced. Those skilled in the art will recognize that one or more of the second type of measuring device can be combined to off-set the degradation of image reproduction caused by the deterioration of developer.

In the present embodiment, it is difficult to recover a deteriorated state by adjusting only one imaging condition as side effects occur by adjusting each condition. In the exemplary embodiment each condition is optimized to offset the effect of deterioration of developer. Of course, at some point, the developer will deteriorate to an extent to which it becomes impossible to adjust the operation of the device to account for the degree of developer deterioration. In such a case, the developer is replaced. However, it is difficult to replace only a carrier, so developer is replaced as a two-component developer material.

A method for changing developer is explained below. At first, after exercising a movement of enforced toner consumption (explained below), a deteriorated toner is exhausted from developing device 4 via a latent image carrier. Next, a new toner is replenished to developing means by toner supplying means as explained below in relation to FIG. 7. This is a remedy in the case that a developing ability is degraded by the toner deterioration. A latent image for dark image is formed on the photoconductor 1, so large quantities of toner is used to develop that the deteriorated toner is exhausted from developing device 4. The developed deterioration toner is removed from the photoconductor 1 by photoconductor cleaning unit 6. This is a movement of enforced toner consumption. In this way, after exhausting a deterioration toner from developing device 4, a new toner is replenished via a supplying mechanism and no special mechanism for exhausting such toner is required.

Figure 7:
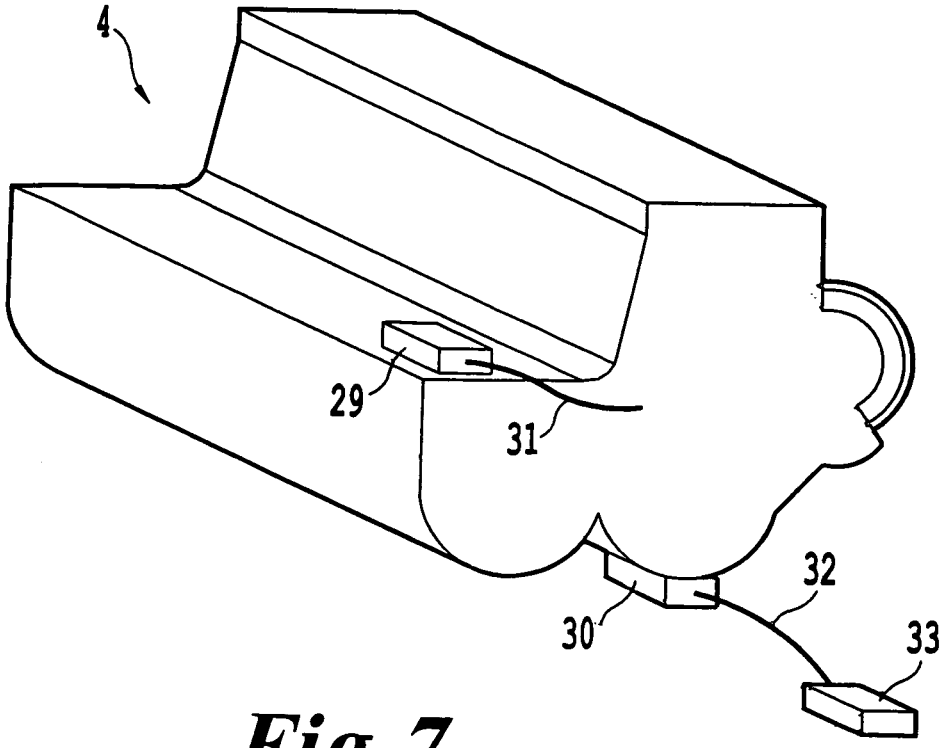
FIG. 7 shows a perspective view of the supplying mechanism of the image forming apparatus of FIG. 1.

Referring now more specifically to FIG. 7, a perspective view of a supplying mechanism of new toner is shown. A pump 29 and conveyance tube 31 corresponds to the supplying mechanism. The conveyance tube 31 is connected to a reservoir or "bottle" of new toner for supplying new toner therefrom. In the exemplary embodiment, the pump 29 is a mono-pump, however, alternative structure is possible as known to those skilled in the art, such as conveyance screws. If developer deterioration is caused by toner deterioration, toner is replenished by the supplying mechanism. If developer deterioration is caused by toner deterioration mainly, it can recover to interchange toner in this way. In addition, by exhausting toner from developing device 4 without requiring a special mechanism, a manufacturing cost benefit is realized. Furthermore, by replacing only toner, it can be cost-down than a case to replace the whole developer.

In a further exemplary embodiment, a method to replace both a toner and a carrier at the same time is shown. It is effective when both the toner deterioration and carrier deterioration occur. The deterioration developer is exhausted via discharge mechanism of FIG. 7 the from developing device 4. After the desired quantity of developer is exhausted, it is replenished to the developing device 4 with new developer that a carrier and a toner were mixed with in the desired degree. In this way, the developing ability is recovered by replacing the developer, which may be done automatically if this function is mechanically provided. In some machines, however, this function may be omitted to reduce apparatus size and manufacturing cost.

In the exemplary embodiment, a method to display a notice indicating the need for interchanging of developer either by the user or a skilled service person is provided. If the functionality of interchanging a developer device 4 directly and a developer tank with a developer can be made by the user, then it is possible to avoid exhausting the developer from the developer device 4. A method to alarm the management center 33 of needed service via a communication line 32 is utilized, e.g., with copy machines, maintained by service persons, known to those skilled in the art. In this way, the management center can be notified by a notice device 30 of needed service to the machine without user intervention, and dispatch a service person to immediately interchange a developer. Likewise, a message or alert may be provided to a control panel or display window of the apparatus.

Thus, the foregoing discussion discloses and describes mere exemplary embodiments of the present invention. As will be understood by those skilled in the art, the present invention may be embodied in other specific forms without departing from the spirit or essential characteristics thereof. Accordingly, the disclosure of the present invention is intended to be illustrative, but not limiting of the scope f the invention as well as other claims. The disclosure, including any readiliy discernible variants of the teachings herein, define, in part, the scope of the foregoing claim terminology such that no inventive subject matter is dedicated to the public.

This Application claims the benefit of priority document JP 2002-266328, filed in Japan on Nov. 20, 2002, the contents of which is incorporated by reference herein in its entirety.

What is claimed is:

1. An image forming apparatus having a latent carrier, a charging device configured to charge a surface of the latent carrier, an exposure device configured to expose a surface of the latent carrier for forming a latent image, and a transfer device provided to transfer a developed toner image on the latent carrier to a recording medium, comprising:

a developing device having a developer carrier, the developer carrier configured to replenish the developer to the latent carrier;

a pooling portion configured to pool a two-component developer, the two-component developer including:

an agitating device, the agitating device configured to agitate the two-component developer in the pool portion; and a first measurement device and a second measurement device configured to measure first and second developer characteristics having first and second values, respectively, the first characteristic being different from the second characteristic, the first measurement device having an operation principle different from the second measurement device, wherein a deterioration rate of the two-component developer is determined based on detection results of the first and second measurement devices.

2. The image forming apparatus of claim 1, wherein the first measurement device is a developer reflection intensity sensor.

3. The image forming apparatus of claim 1, wherein the second measurement device is a developer magnetic permeability sensor.

4. The image forming apparatus of claim 1, wherein the second measurement device measures a torque of the agitating device.

5. The image forming apparatus of claim 1, wherein the second measurement device measures an electric resistance of the developer.

6. The image forming apparatus of claim 1, wherein an image forming condition is configured to be changed according to a determined deterioration rate of developer.

7. The image forming apparatus of claim 6, wherein the image forming condition is a charging bias value of the charging device.

8. The image forming apparatus of claim 6, wherein the image forming condition is an exposure power of the exposure device.

9. The image forming apparatus of claim 6, wherein the image forming condition is a developing bias value of the developing device.

10. The image forming apparatus of claim 6, wherein the image forming condition is a rotating speed of the developer carrier.

11. The image forming apparatus of claim 6, wherein the image forming condition is configured to change to negate an affection of deteriorated developer.

12. The image forming apparatus of claim 1, wherein the developer in the developing device is configured to replace the developer according to the determined deterioration rate of the developer.

13. The image forming apparatus of claim 12, further comprising:

a toner replenishing device, the toner replenishing device configured to provide new toner to the developing device responsive to toner consumption.

14. The image forming apparatus of claim 12, further comprising:

a new developer replenishing device, the new developer replenishing device configured to provide the new developer to the developing device, wherein the new developer is proportioned with a magnetic carrier and non-magnetic toner properly;

a discharging device, the discharging device configured to discharge a deteriorated developer;

wherein the new developer replenishing device is configured to provide the new developer to the developing device after discharging the deteriorated developer by the discharging device.

15. The image forming apparatus of claim 1, further comprising:

a notice device, the notice device configured to notify the need to replace the developer in the developing device according to the determined deterioration rate of the developer.

16. The image forming apparatus of claim 15, wherein the notice device is configured to show a notice on an operator panel.

17. The image forming apparatus of claim 15, wherein the notice device is configured to transmit information to a control center via a communication line.

* * * * *